US005289814A

United States Patent [19]

Maisano

[11] Patent Number: 5,289,814

[45] Date of Patent: Mar. 1, 1994

[54] ADJUSTABLE ARCHERY BOW SIGHT

[76] Inventor: Joseph A. Maisano, 38 Hickory Dr., Dudley, Mass. 01571

[21] Appl. No.: 985,947

[22] Filed: Dec. 4, 1992

[51] Int. Cl.[5] ..... F41G 1/467

[52] U.S. Cl. ..... 124/87; 33/265

[58] Field of Search ..... 124/23.1, 24.1, 25.6, 124/86, 87, 88; 33/265

[56] References Cited

U.S. PATENT DOCUMENTS

| | | | |
|---|---|---|---|
| 3,056,206 | 10/1962 | Moore | 33/265 |
| 3,084,442 | 4/1963 | Jacobson et al. | 33/265 |
| 3,854,217 | 12/1974 | Killian | 33/265 |
| 4,584,777 | 4/1986 | Saunders | 33/265 |
| 4,625,421 | 12/1986 | Strauss | 33/265 |
| 4,757,614 | 7/1988 | Kudlacek | 33/265 |
| 4,875,290 | 10/1989 | Finch | 33/265 |
| 5,072,716 | 12/1991 | Sappington | 124/87 |
| 5,092,053 | 3/1992 | Roberts | 33/265 |
| 5,131,153 | 7/1992 | Seales | 33/265 |
| 5,228,204 | 7/1993 | Khoshnood | 33/265 |

*Primary Examiner*—Randolph A. Reese
*Assistant Examiner*—John Ricci
*Attorney, Agent, or Firm*—Blodgett & Blodgett

[57] ABSTRACT

An adjustable archery bow sight for attachment to an archery bow to facilitate archery accuracy. The adjustable archery bow sight includes a base, a carriage which is slidably mounted to the base and a mechanism connected to the base to attach the adjustable archery bow sight to the bow. A sight pin assembly is mounted to the carriage. One of the carriage and the base has a planar surface. A drive roll is mounted to the other of the base and the carriage. The drive roll has an outer circumferential surface which engages the planar surface. One of these two surfaces is knurled and non-conformable and the other of these two surfaces is softer than the knurled surface and conformable in a complementary driving manner to the knurled surface. Rotation of the drive roll about an axis of rotation causes the carriage to slide relative to the base. The adjustable archery bow sight is further provided with a rotating mechanism for rotating the drive roll. In one embodiment, the drive roll is mounted to the base and the circumferential surface of the drive roll is knurled and non-conformable. The planar surface is softer than the circumferential surface and conformable. A mechanism is also provided for controlling the force between the two surfaces and the resistance of the drive roll to being turned.

18 Claims, 7 Drawing Sheets

ADJUSTABLE ARCHERY BOW SIGHT

BACKGROUND OF THE INVENTION

The field of invention relates generally to devices for increasing the accuracy of bow sightings, and, more particularly, pertains to adjustable archery bow sights for use in tournaments or while hunting.

An adjustable archery bow sight typically will carry one or more sight pins and will be mounted on an archery bow within the line of sight of the archer. The sight will allow movement of the sight pin along either two or three axes of movement and is used to direct the archer in the proper elevation of the bow. The proper elevation will be a function of at least wind, gravity, and the intended range of flight of the arrow.

A properly designed adjustable archery bow sight must be durable since it will often be utilized during adverse conditions. In addition, such a sight must be easy to adjust, since several rapid adjustments will be required during a tournament or while hunting. Furthermore, such a sight must be accurate; and, during a tournament, such accuracy must be reproducible. Specifically, the sight must not alter from its initial setting due to the vibration from shooting arrows. Also, such a sight must be easy to maintain as accuracy is impaired by wear or dirt. Finally, the sight must be adaptable. The adaptation may be for right or left hand shooting, or it may be for different types of equipment Adjustable archery bow sights are known. However, a review of the prior art bow sights indicates several problems with the prior art sights. Many of the prior art sights have multiple sight pins. This feature not only leads to a decrease in accuracy, but also increases the time required to make the necessary adjustment settings.

Further, a number of the prior art sights are not adaptable for left-handed shooters. This eliminates the usefulness of the sight for a large population of archers.

Furthermore, all of the known prior art sights have a large number of moving parts. A large number of moving parts leads to a more fragile device that is susceptible to damage during the rigors of hunting or of a tournament. A further consequence of the many moveable parts is that the devices are cumbersome, sometimes to the extent of hindering arrow or broadhead clearance.

The position of the sight pins of the prior art sights relative to the bow can be changed by either sliding one part on a dovetail track of another part, or by a screw mechanism. Such mechanisms typically require lubrication. This lubrication is often not performed, leading to maintenance problems. Further, the lubricant often attracts dirt and debris into the open mechanism, thereby accelerating wear and leading to inaccuracy.

Still another problem with the sights of the prior art is that they typically require locking screws to lock the moveable mechanisms in place once their position is attained. This severely adds to the time involved to change an adjustment, since the locking screw must be loosened, prior to repositioning the moveable part, and then re-tightened, after repositioning the moveable part. There is also the potential of losing a locking screw by over loosening it. Finally, the constant tightening and loosening of the locking screws can cause damage to the body of the device.

A further problem with the prior art devices is that there is no provision for adjusting the tension among the various moving parts of the sights. Over time, wear will greatly loosen the tension, leading to inaccuracy.

These and other difficulties experienced with the prior art devices have been obviated in a novel manner by the present invention.

It is, therefore, a principle object of the invention to provide an adjustable archery bow sight that has a single sight pin for improved accuracy and reduced adjustment time.

Another object of this invention is the provision of an adjustable archery bow sight that is easily convertible from a form useable by a right-handed archer to a form useable by a left-handed archer.

A further object of the present invention is the provision of an adjustable archery bow sight that has a relatively few number of moveable parts.

It is another object of the instant invention to provide an adjustable archery bow sight that is compact, allowing for clearance of an arrow or a broadhead arrow tip.

A still further object of the invention is the provision of an adjustable archery bow sight that does not require lubrication.

It is a further object of the invention to provide for an adjustable archery bow sight that does not require locking screws.

It is a still further object of the present invention to provide an adjustable archery bow sight that is equipped with a tension adjustment mechanism.

Another object of the invention is the provision of an adjustable archery bow sight with a distance marker that is removable.

The further object of the present invention is the provision of an adjustable archery bow sight that is sufficiently durable to withstand use in both hunting and tournaments.

It is another object of the instant invention to provide an adjustable archery bow sight that is easy to adjust.

A still further object of the invention is the provision of an adjustable archery bow sight that is accurate in a reproducible manner.

It is a further object of the invention to provide an adjustable archery bow sight that is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

Disclosed is an adjustable archery bow sight for attachment to a bow. The adjustable archery bow sight comprises a base and mounting means connected to the base to provide for attachment of the adjustable archery bow sight to the bow. The adjustable archery bow sight is further comprised of a carriage which is slidably mounted on the base for movement along an axis of travel. The sight further has a planar surface on one of said carriage and said base, and a drive roll which is mounted on the other of said base and said carriage for rotation about an axis of rotation. The drive roll has an outer circumferential surface which engages the planar surface.

A first one of said circumferential surface and said planar surface is knurled and non-conformable, and a second one of said circumferential surface and said planar surface is softer than the first surface and conformable in a complimentary driving manner to the first surface. Rotation of the drive roll about the axis rotation causes the carriage to slide relative to the base along the axis of travel. The sight is further provided with rotating means for rotating the drive roll about the axis of rotation. The sight is further comprised of a sight pin assembly that is mounted on the carriage.

In one embodiment, the drive roll is mounted to the base and the circumferential surface of the drive roll is knurled and non-conformable, with the planar surface being softer than the circumferential surface. The planar surface that is conformable will retain an imparted deformation. The conformable surface is formed from a crystalline thermoplastic polymer known as polyoxymethylene. This polymer has natural lubricity and eliminates the need for a separate lubricant. The mounting means is comprised of a mounting arm which is adjustably mounted on the base and adjustably attached to the bow, so that the central longitudinal axis of the mounting arm will be transverse to the axis of travel of the carriage. The sight pin assembly is also adjustably mounted on the carriage to allow for movement parallel to the axis of travel. The rotating means is comprised of a shaft which rotatably supports the drive roll and a finger grip adjustment knob connected to the shaft. The proper pressure between the knurled surface and the conformable surface is maintained through pressure applying means. The pressure applying means comprises pressure screw means which is mounted in the base and which operatively engages the shaft. The base has at least one threaded hole which extends from the shaft to the outside of the base. The pressure screw means comprises at least one plug which is freely slidable within the threaded hole and which abuts the shaft and at least one screw which is threaded into the threaded hole and which abuts the plug. The plug is formed of a material which is softer than the material of the shaft.

All of the structure described thus far, with the exception of the sight pin assembly, comprises an adjustable archery sight pin assembly carrier.

The adjustable archery bow sight of the present invention has very few moving parts to allow for durability in the field and reduced wear, is compact, allowing for clearance of the arrow and a broadhead arrow tip, has a single pin to increase accuracy and reduce the time for adjustment, and is equipped with a tension adjustment mechanism that can tailor the invention for the individual user's preference.

The invention is adaptable for use by either a left-handed or a right-handed user, and obviates the need for locking screws preventing the loss of valuable time for adjustment and potential damage to the housing, not to mention the added risk of losing a locking screw in the field. Further, the distance marker is removable for alternative equipment or changing from left-handed to right-handed use. In addition, there is no need for lubrication. Therefore, what is shown is an adjustable archery bow sight that is durable, easy to adjust, accurate with reproducability, adaptable and easy to maintain.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
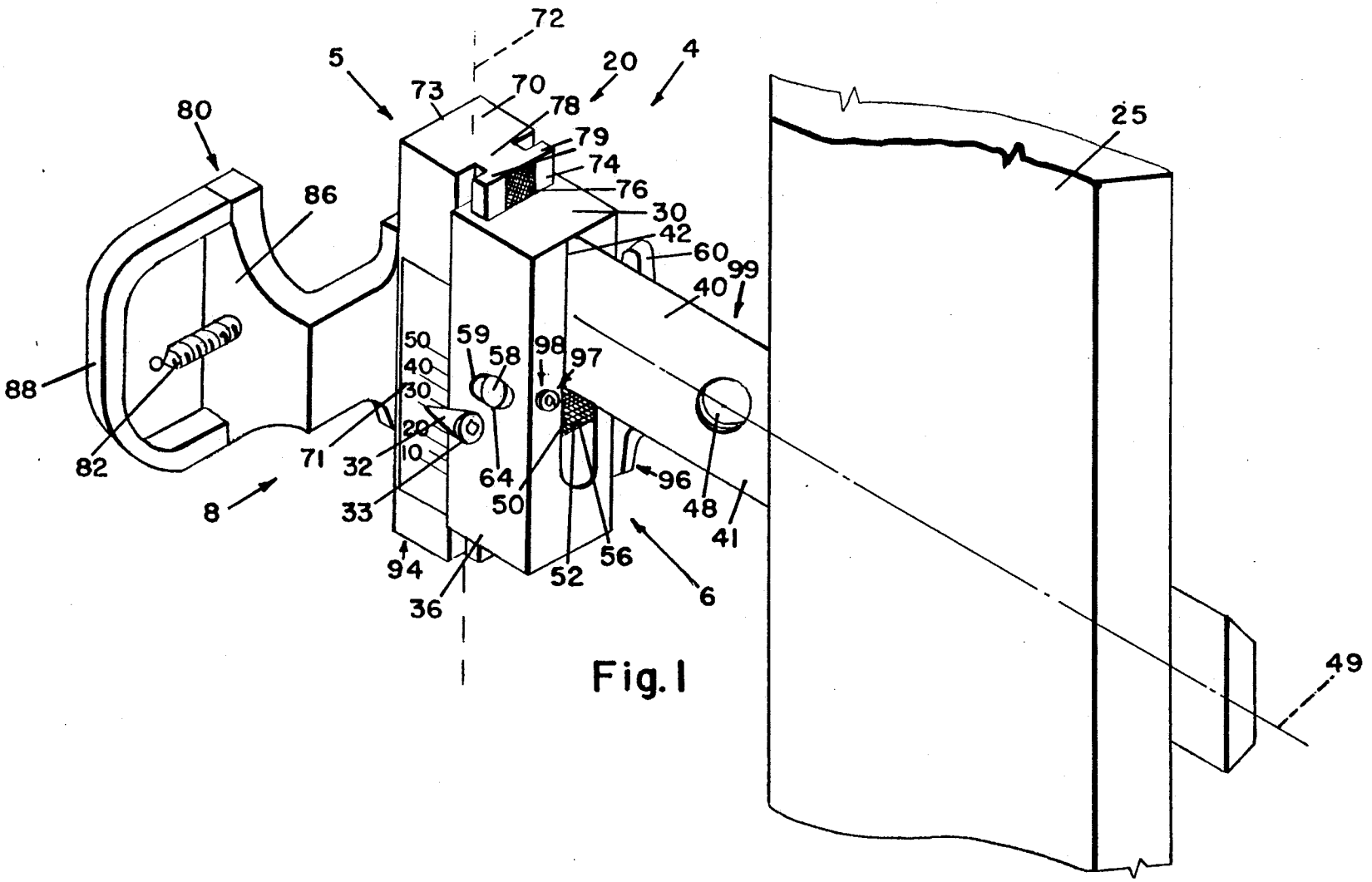
FIG. 1 is a perspective view of an adjustable archery bow sight, embodying the principles of the present invention, mounted on an archery bow, and as seen from a point that is above and to the archer's left.
Figure 2:
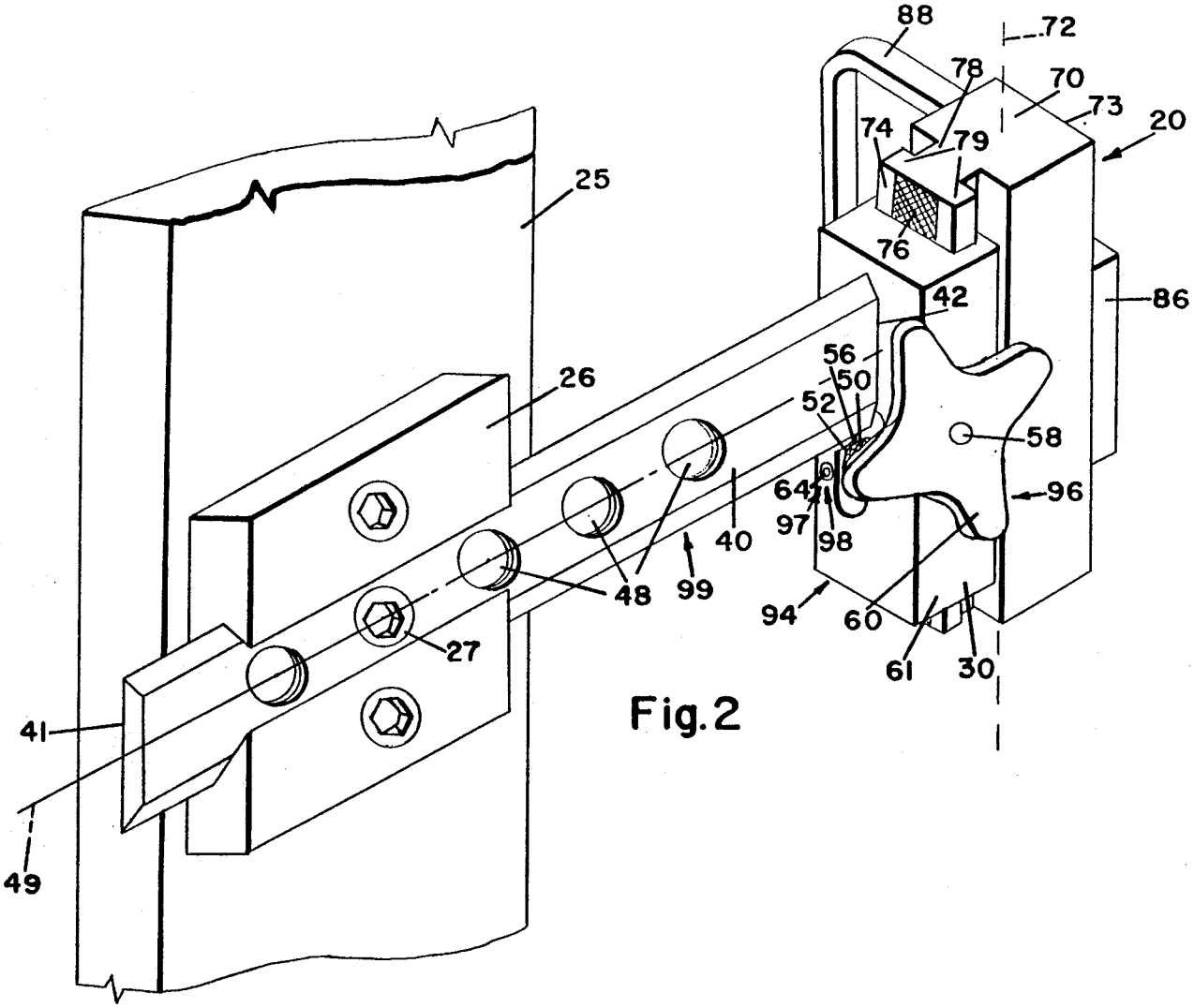
FIG. 2 is a perspective view of the adjustable archery bow sight, embodying the principles of the present invention, mounted on an archery bow, and as seen from a point that is above and to the archer's right.
Figure 3:
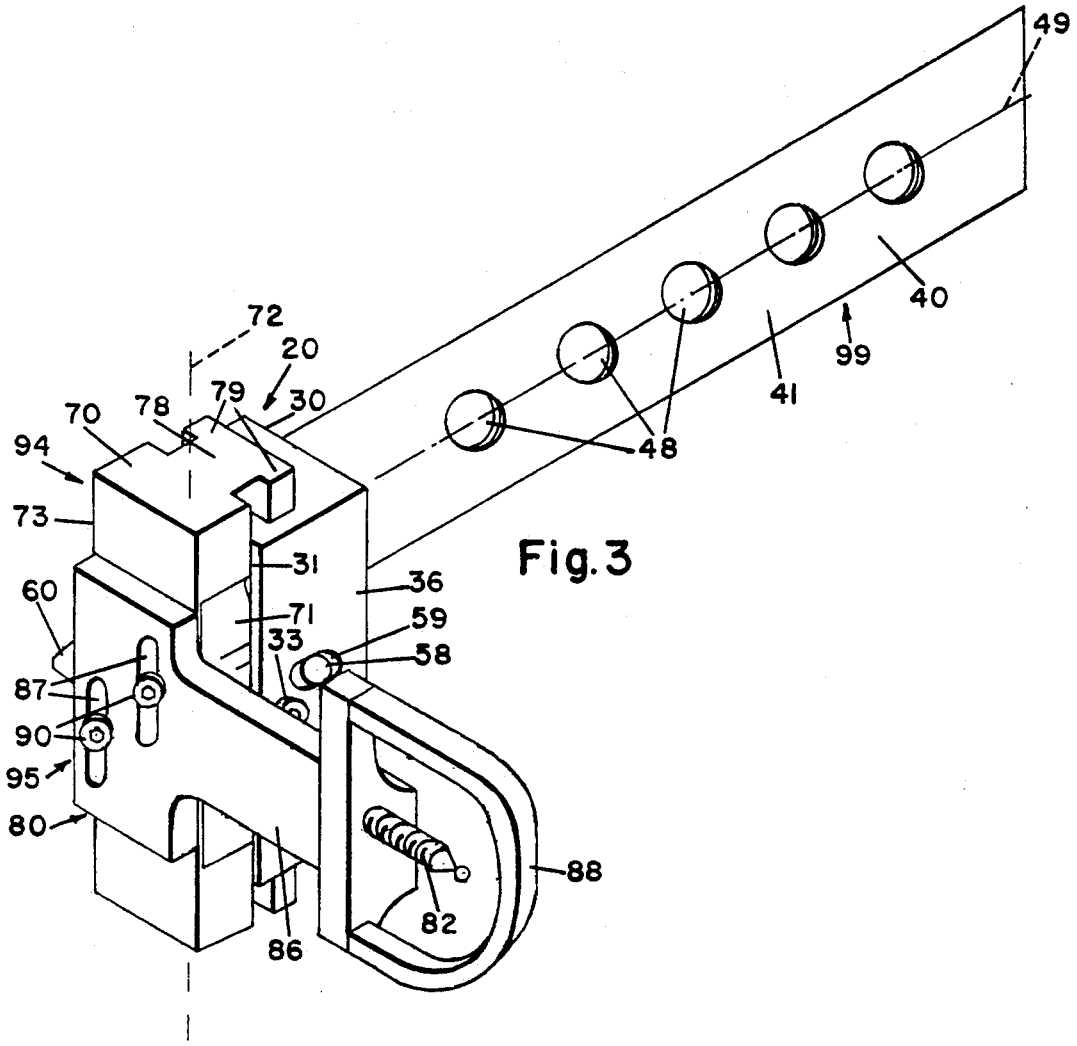
FIG. 3 is a perspective view of the adjustable archery bow sight, embodying the principles of the present invention, and as seen from a point in front of and to the archer's left.

With reference now to the drawings, there is shown in FIGS. 1-3, an adjustable archery bow sight, embodying the principles of the present invention, and generally indicated by the reference numeral 20. Bow sight 20 is shown in FIG. 1 mounted to a portion of an archery bow 25 by means of a mounting arm 40. A surface 42 of the mounting arm 40 is attached to a base 30 of the bow sight 20. A drive roll 50 is mounted to the base 30, and a carriage 70 is slidably mounted on the base 30 for movement along an axis of travel 72. The outer circumferential surface 52 of the drive roll 50 engages a planar surface 74 on the carriage 70, such that rotation of the drive roll 50 causes the carriage 70 to slide relative to the base 30 along the axis of travel 72. Rotating means 96 for rotating the drive roll 50 about an axis of rotation 62 is also provided. The sight pin assembly 80 is mounted to the carriage 70.

As shown in FIG. 2, a mounting arm 40 is fitted in a standard manner to a mounting seat 26 on a bow 25. The inwardly facing side 41 of the mounting arm 40 is in contact with the mounting seat 26. The position of the mounting arm 40 relative to the mounting seat 26 can be selected by aligning any of the mounting arm holes 48 with a detent (not shown) on the mounting seat 26 and securing the mounting arm 40 to the mounting seat 26 with a mounting seat screw 27.

The surface 42 of the mounting arm 40 is adjustably mounted on the base 30 so that a central longitudinal axis 49 of the mounting arm 40 is transverse to the axis of travel 72 of the carriage 70.

The method of adjustably mounting the mounting arm 40 on the base 30 will be discussed later.

Figure 7:
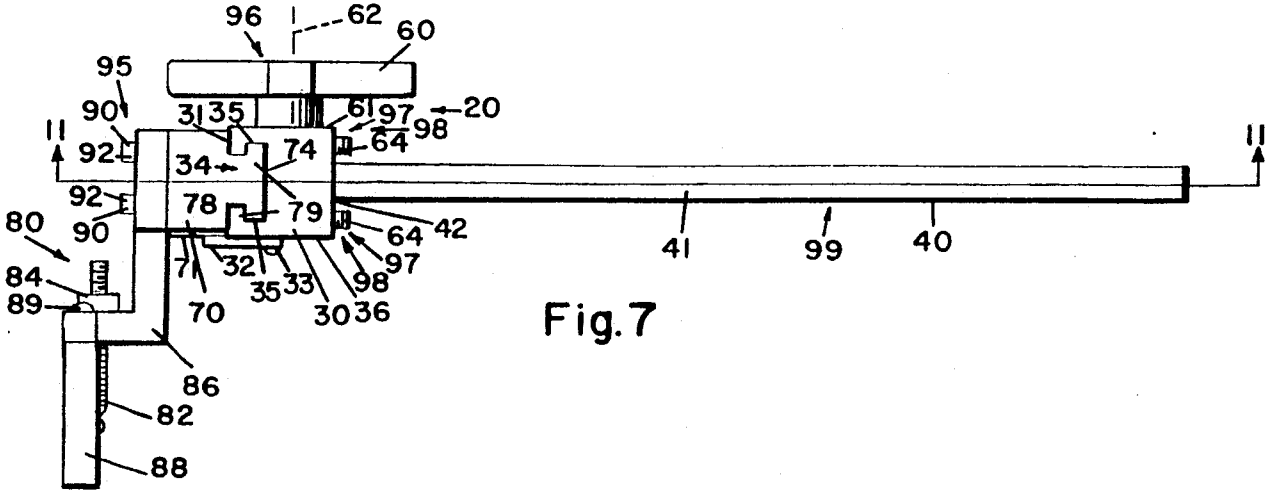
FIG. 7 is a top planar view of the adjustable archery bow sight of FIG. 1.
Figure 8:
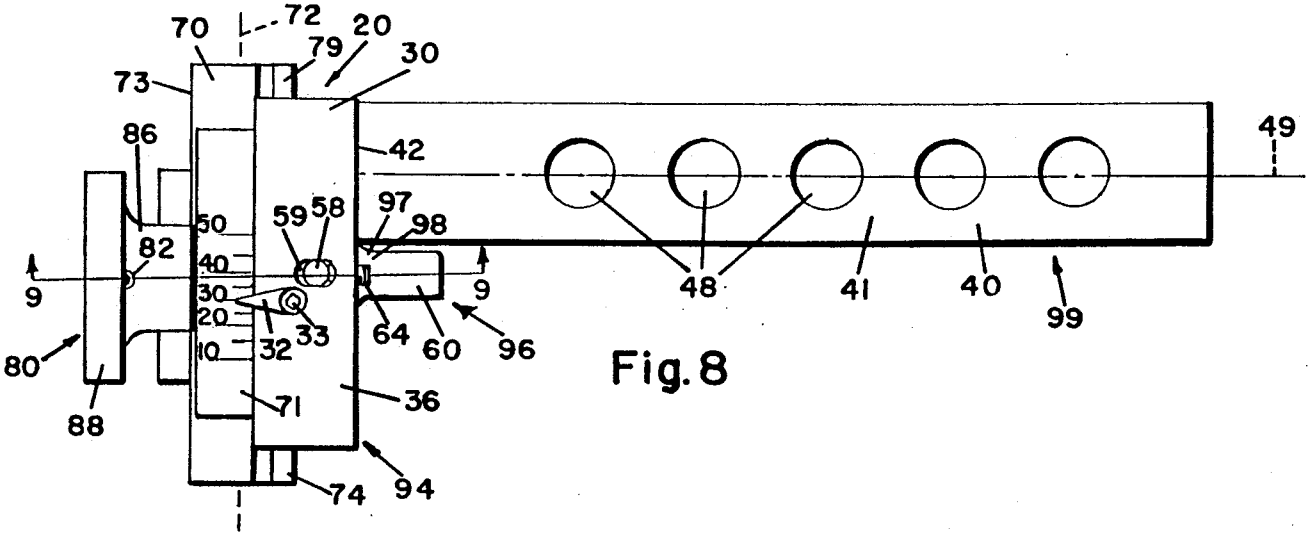
FIG. 8 is an end view of the adjustable archery bow sight of FIG. 1, looking in the direction of arrow 8.
Figure 9:
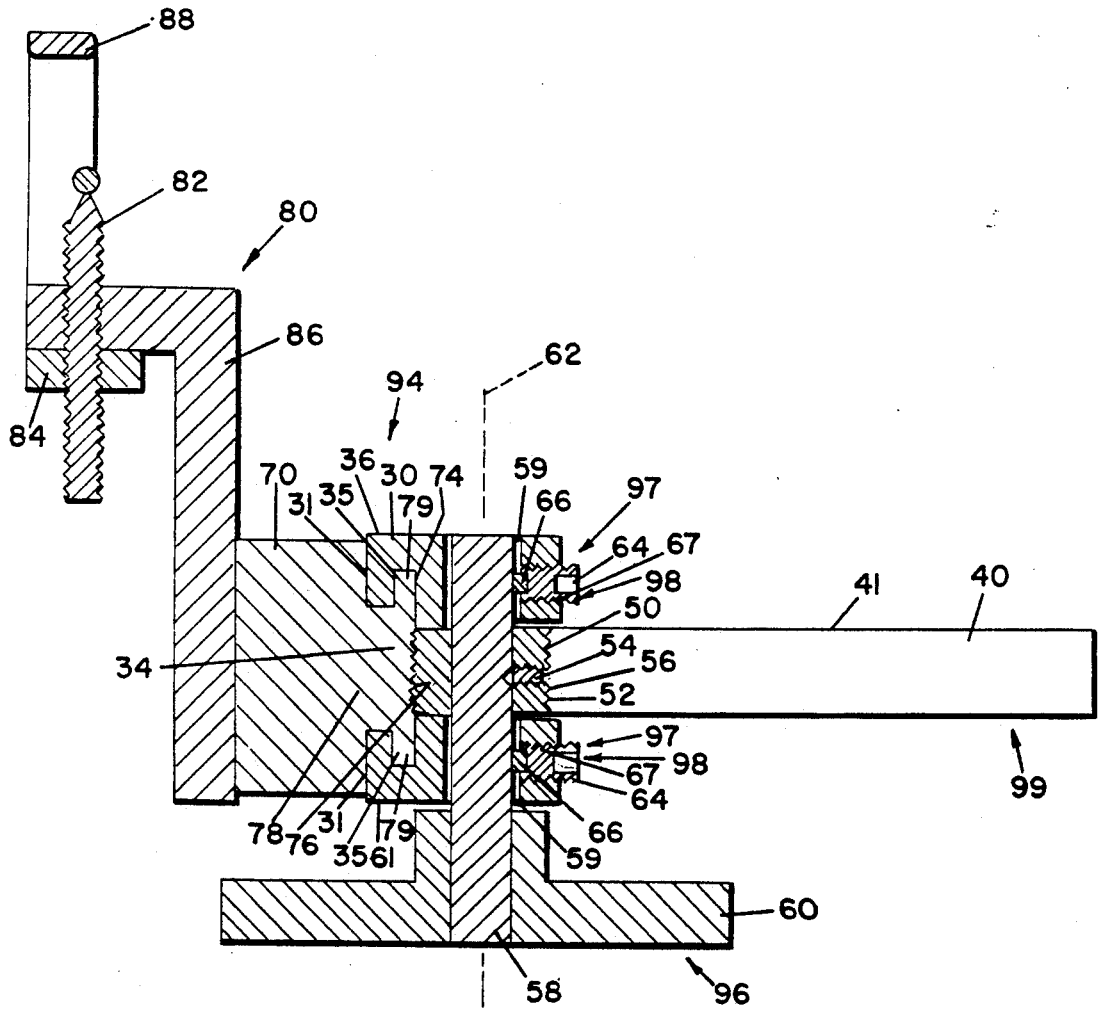
FIG. 9 is a horizontal cross-section of the adjustable archery bow sight of FIG. 8, taken along the line 9—9 thereof, and looking in the direction of the arrows.
Figure 10:
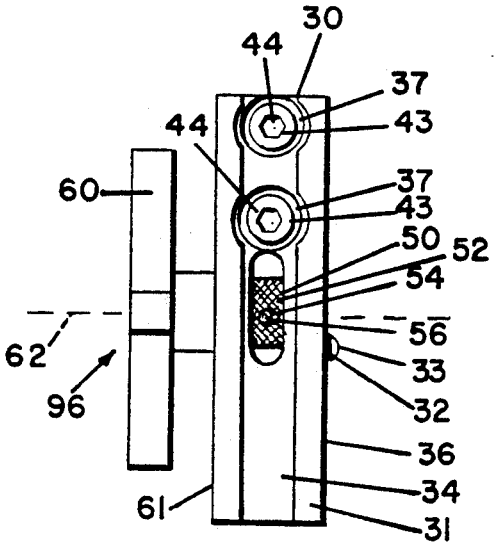
FIG. 10 is a similar view to that of FIG. 5, showing the adjustable archery bow sight without the carriage and without the sight pin assembly.

With reference to FIGS. 1-11, the base 30 has a forward surface 31 that is best represented in FIGS. 9 and 10. The forward surface 31 has a longitudinal groove 34 that extends the entire length of the base 30. As is depicted in FIGS. 7 and 9, undercuts 35 are provided at the deepest portion of the groove 34. As will be explained later, the groove 34, with its undercuts 35, allows for the slidable movement of the carriage 70.

Figure 4:
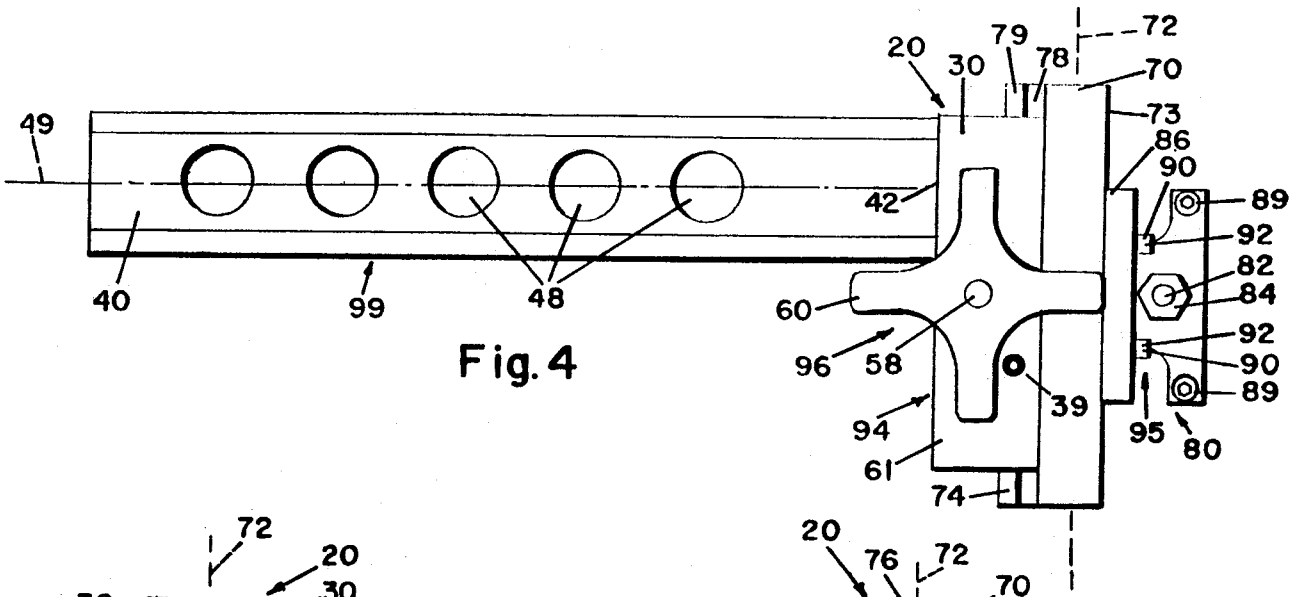
FIG. 4 is an end view of the adjustable archery bow sight of FIG. 1, looking in the direction of arrow 4.
Figure 6:
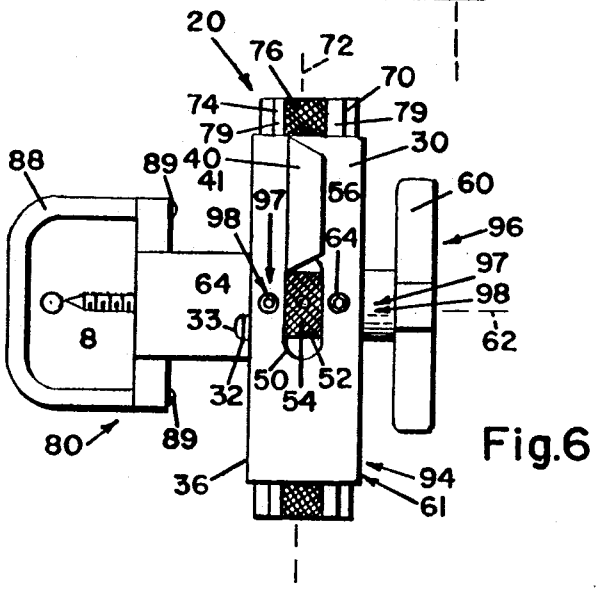
FIG. 6 is a rear elevational view of the adjustable archery bow sight of FIG. 1, looking in the direction of arrow 6.
Figure 5:
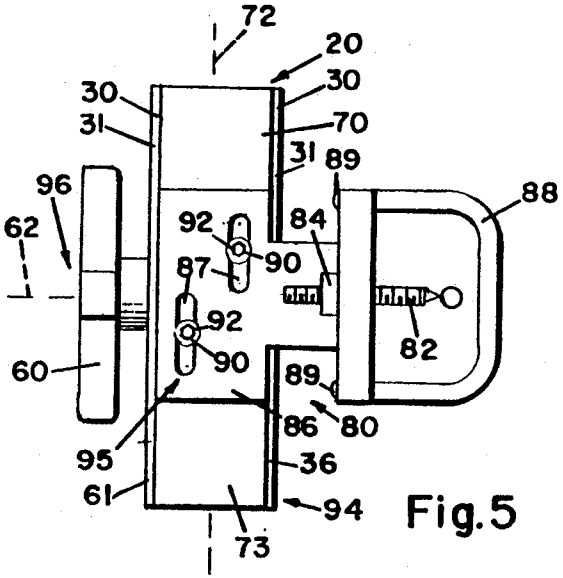
FIG. 5 is a front elevational view of the adjustable archery bow sight of FIG. 1, looking in the direction of arrow 5.

The adjustable archery bow sight 20 can be adjusted to accommodate a right-handed archer. Referring to FIGS. 4, 7 and 8, a fixed pointer 32 is attached to the left side 36 of the base 30 by a pointer screw 33 which is threaded into a pointer screw hole. As can be seen in FIG. 4, a threaded pointer screw hole 39 is provided in the right side 61 of the base for receiving the screw 33 to accommodate the proper positioning of the fixed pointer 32 for a left-handed archer.

Figure 11:
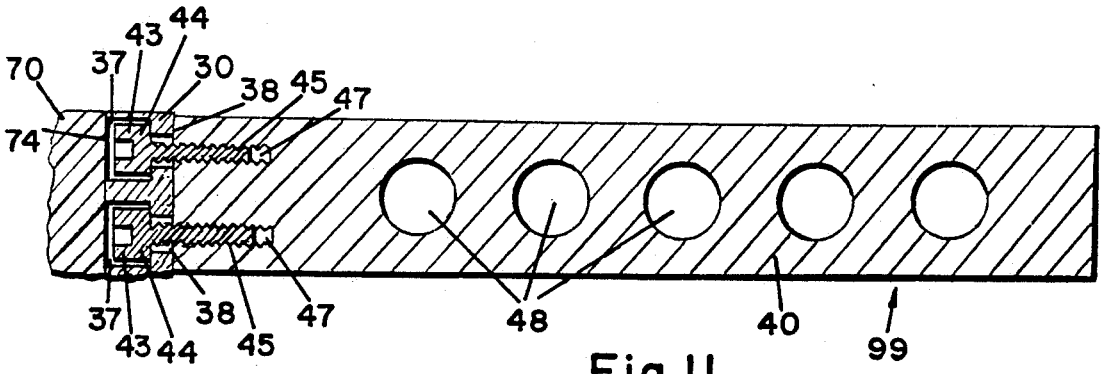
FIG. 11 is a portion of a horizontal cross-section of the adjustable archery bow sight of FIG. 7, taken along the line 11—11 thereof, and looking in the direction of the arrows.

In the forward surface 31 of the base 30, located at the deepest portion of the groove 34, are two circular recessed areas 37. This structure, is best depicted in FIGS. 10 and 11. At the center of each circular recessed area, is an unthreaded smooth bore 38, extending completely through the base. A bow alignment adjustment screw 43, having a bow alignment adjustment screw head 44 and a bow alignment adjustment shank 45, is positioned within each circular recessed area 37 and within the unthreaded smooth bore 38, such that the bow alignment adjustment screw head 44 fits entirely within the circular recessed area 37 and the bow alignment adjustment screw shank 45 fits within the unthreaded smooth bore 38. The bow alignment adjustment screw head 44 is sized to be substantially larger than the diameter of the unthreaded smooth bore 38, but substantially smaller than the diameter of the circular recessed area 37. The bow alignment adjustment screw shank 45 is sized to have a diameter substantially smaller than the diameter of the unthreaded smooth bore 38, allowing for movement of the bow alignment adjustment screw shank 45 within the unthreaded smooth bore 38. As is shown in FIG. 11, two threaded bow alignment adjustment screw holes 47 are positioned in the surface 42 of the mounting arm that has been fixed to the base 30. These threaded bow alignment adjustment screw holes 47 receive the bow alignment adjustment screw shanks 45. In this manner, the mounting arm 40 is adjustably mounted on the base 30 so that the central longitudinal axis 49 of the mounting arm 40 is transverse to the axis of travel 72 of the carriage 70.

A drive roll 50 is mounted to the base 30, for rotation about an axis of rotation 62. The drive roll 50 has an outer circumferential surface 52 which is knurled and nonconformable, forming a knurled surface 56. Referring to FIGS. 1, 6, 9 and 10, it can be seen that a shaft 58 rotatably supports the drive roll 50. The drive roll 50 is secured to the shaft 58 by means of a drive roll screw 54. The shaft 58 is journaled in two shaft receiver slots 59, one of the shaft receiver slots 59 being located on the left side 36 of the base 30, and the other shaft receiver slot 59 being located on the right side 61 of the base 30. A finger grip adjustment knob 60 is attached to the portion of the shaft 58 that extends beyond the shaft receiver slot 59 located on the right side 61 of the base 30. As will be explained, rotation of the drive roll 50 about its axis of rotation 62 causes the carriage 70 to slide relative to the base 30 along the axis of travel 72.

The base 30 has at least one threaded hole 67 which extends from said shaft 58 to the outside of the base 30. A plug 66 is freely slidable within the threaded hole 67. The plug 66 abuts the shaft 58. A pressure screw 64, which is threaded into the threaded hole 67, abuts the plug 66. The plug 66 is formed of any material which is softer than material of the shaft 58, but brass is typically employed.

A carriage 70, generally having the shape of a rectangular solid, is slidably mounted on the base 30 for movement along an axis of travel 72. Reference should be had to FIGS. 1-9. A tongue 78 extends along the entire length of the carriage 70. The tongue 78 is formed so as to slidingly fit into the groove 34 of the base 30. Lateral extensions 79 of the tongue 78 are provided. The lateral extensions 79 are formed so as to fit into the undercuts 35 of the groove 34. As can be seen in FIGS. 1-4 and 6-9, the tongue 78, groove 34, lateral extensions 79 and undercuts 35 act to limit the movement of the carriage 70 to a direction parallel to the axis of travel 72. The tongue 78 and lateral extensions 79 form a planar surface 74 on the carriage 70. The outer circumferential surface 52 of the drive roll 50 engages the planar surface 74 of the carriage 70. The planar surface 74 of the carriage 70 is softer than the knurled surface 56 of the drive roll 50 and is conformable in a complimentary driving manner to the knurled surface 56 of the drive roll 50. The knurled surface 56 imparts a deformation 76 to the planar surface 74 which retains the imparted deformation 76. As is now apparent, rotation of the drive roll 50 about the axis of rotation 62 causes the carriage 70 to slide relative to the base 30 along the axis of travel 72.

The planar surface 74 may be formed from any appropriate conformable material. Especially acceptable are any of the plastic polymers. Especially appropriate is the crystalline thermoplastic polymer known as polyoxymethylene.

A distance marker 71 is removably attached to the left side 36 of the base 30. Reference should be had to FIGS. 1, 3, 7, and 8. The distance marker 71 acts with the fixed pointer 32 to allow the archer to place the carriage 70 in the proper orientation relative to the base 30. A sight pin assembly 80 is adjustably mounted on the carriage 70 to allow for movement of the sight pin assembly 80, parallel to the axis of travel 72. The sight pin assembly 80 is comprised of the sight pin holder 86 and a sight pin guard 88 attached to the sight pin holder 86 with two sight pin guard screws 89. Other fasteners for attaching the sight pin guard 88 to the sight pin holder 86 may be used as well. Sight pin 82 is typically provided by the archer to allow for personal preference. The sight pin 82 is held in place on the sight pin holder 86 with a sight pin nut 84. The portion of the sight pin holder 86 that is to contact the forward surface 73 of the carriage 70, is equipped with two sight pin assembly adjustment screws slots 87. Each sight pin assembly adjustment screw slot 87 is adapted to receive a sight pin assembly adjustment screw 90. The sight pin assembly adjustment screw 90 is comprised of a sight pin assembly adjustment screw shank (not shown) and a sight pin assembly adjustment screw head 92. The sight pin assembly adjustment screw slots 87 have a width that is greater than the sight pin assembly adjustment screw shank (not shown) but narrower than the sight pin assembly adjustment screw head 92. Each sight pin assembly adjustment screw 90 passes through the sight pin assembly adjustment screw slot 87 and engages a sight pin assembly adjustment screw hole (not shown) in the forward surface 73 of the carriage 70.

An adjustable archery sight pin assembly carrier 94 for carrying a sight pin assembly 80 and for attachment to a bow 25 is also disclosed. The adjustable archery sight pin assembly carrier 94 is comprised of all of the structure mentioned above, with the exception of the sight pin assembly 80.

A means 95 for mounting the sight pin assembly 80 is comprised of the sight pin assembly adjustment screw holes (not shown) that are in the forward surface 73 of the carriage 70 and the sight pin assembly adjustment screws 90 including the sight pin assembly adjustment screw shanks (not shown) and the sight pin assembly adjustment screw heads 92.

A rotating means 96, for rotating the drive roll 50 about the axis of rotation 62, is comprised of the shaft 58 which rotatably supports the drive roll 50, and the finger grip adjustment knob 60 which is connected to the shaft 58.

A pressure applying means 97 for forcing the knurled surface 56 against the planar surface 74, is comprised of a pressure screw means 98 which is mounted in the base 30 and which operatively engages the shaft 58. Pressure screw means 98 comprises plug 66 which is freely slidable within the threaded hole 67 and which abuts the shaft 58, and the pressure screw 64 which is threaded into the threaded hole 67 and which abuts the plug 66.

A mounting means 99 is connected to the base 30 to provide for attachment of the adjustable archery bow sight 20 to the bow 25. The mounting means 99 is comprised of the mounting arm 40, affixed to the base 30. The mounting arm 40 is adjustably attachable to the bow 25.

The invention having been thus described, the operation will now be clear to those of ordinary skill in the art as described below.

Use of the adjustable archery bow sight 20 is begun by attaching the adjustable archery bow sight 20 to the bow 25. This is accomplished in the standard manner by sliding the mounting arm 40 into the mounting seat 26 that, for a right-handed archer, appears on the right side of the bow and also the archer's right side. Arm 40 is inserted in the mounting seat 26 so that the inwardly facing side 41 of the mounting arm 40 rests against the base of the mounting seat 26. The distance of the adjustable archery bow sight 20 to the mounting seat 26 may be selected by aligning the desired mounting arm hole 48 with the mounting seat 26 and then securing the mounting arm 40 to the mounting seat 26 with a mounting seat screw 27. The mounting arm 40 is adjustably fixed to the base 30 through use of the bow alignment adjustment screws 43. The position of the base 30 with respect to the mounting arm 40 may be altered by first exposing the bow alignment adjustment screws 43. This is accomplished by removing or lowering the carriage 70 on the base 30. Once exposed, the bow alignment adjustment screws 43 are then loosened to allow the base 30 to be moved with respect to the mounting arm 40. Once a desired position is obtained, the bow alignment adjustment screws 43 are then retightened. The carriage 70 is then returned to its normal position, covering the bow alignment adjustment screws 43. This adjustment of the base 30 with respect to the mounting arm 40, permits the base 30 to be properly aligned with respect to the bow 25.

Once the base 30 is properly mounted and aligned with respect to the bow 25, the finger grip adjustment knob 60 may then be rotated. This rotation of the finger grip adjustment knob 60 causes the shaft 58 to rotate, which in turn causes the drive roll 50 to rotate about its axis of rotation 62. The outer circumferential surface 52 of the roll drive 50, also serving as the knurled surface 56, is engaged with the planar surface 74 of the carriage 70. Rotation of the drive roll 50 about its axis of rotation 62, therefore, causes the planar surface 74 to move. This in turn causes the carriage 70 to slide relative to the base 30 along the axis of travel 72.

If the finger grip adjustment knob 60 turns with too much or too little resistance, the pressure with which the knurled surface 56 is forced against the planar surface 74, may be changed. This is accomplished by tightening or loosing the pressure screw 64 that is threaded in the threaded hole 67. Turning the pressure screw 64 in the threaded hole 67 will alter the force that the pressure screw 64 exerts upon the plug 66. This in turn will alter the force that the plug 66 exerts against the shaft 58. Altering the force on the shaft 58 alters the force that the knurled surface 56 will exert against the planar surface 74.

A sight pin 82 of the archer's own preference is secured to the sight pin holder 86 by means of the sight pin nut 84.

The distance marker 71 may be calibrated by firing the bow at targets of known distance from the archer. If, after calibration, new equipment is used with the same adjustable archery bow sight 20, the distance marker 71 may be replaced with a new distance marker for purposes of recalibration.

It is also possible to alter the position of the entire sight pin assembly 80 on the carriage 70 by means of the sight pin assembly adjustment screws 90. The sight pin assembly adjustment screws 90 are first loosened, allowing the sight pin assembly 80 to be moved in a direction parallel to the axis of travel 72. Once the desired location of the sight pin assembly 80 is determined, relative to the carriage 70, the sight pin assembly adjustment screws 90 may be retightened to maintain the selected position.

As previously mentioned, it is possible to adapt the adjustable archery bow sight 20 for use by either a right-handed or left-handed archer. The orientation of the structure mentioned thus far, is for a right-handed archer. The orientation of the structure for a right-handed archer includes a bow 25 with a mounting seat 26 facing the archer's right hand side. The adjustable archery bow sight 20 is orientated to have the finger grip adjustment knob 60 on the archer's right hand side and the sight pin 82 pointing towards the archer's left hand side. The distance marker 71 faces the left hand side of the archer, as does the fixed pointer 32.

The orientation of the structure for a left-handed archer is precisely the opposite. The bow 25 has a mounting seat 26 located facing the archer's left hand side. The finger grip adjustment knob 60 is mounted to be on the archer's left hand side. The sight pin 82 is oriented to point towards the archer's right hand side. The distance marker 71 and fixed pointer 32 face the archer's right hand side.

To adapt the adjustable archery bow sight 20 for use by a left-handed archer, the carriage 70 is removed from the base 30. The fixed pointer 32 and the pointer screw 33 are removed from the left side 36 of the base 30. The distance marker 71 is removed from the side of the carriage 70 facing the archer's left side, and reattached to the side of the carriage 70 facing the archer's right side. The finger grip adjustment knob 60 is positioned to be on the left side 36 of the base 30. This is accomplished by loosening the drive roll screw 54 and sliding the finger grip adjustment knob 60 with attached shaft 58 away from the base through the shaft receiver slot 59 that is located on the right side 61 of the base. The shaft 58 with the finger grip adjustment knob 60 attached is reinserted into the base 30 through the shaft receiver slot 59 located on the left side 36 of the base 30. The fixed pointer 32 and the pointer screw 33 are then reattached to the right side 61 of the base 30. The mounting arm 40 is disconnected from the base 30 by unscrewing the bow alignment adjustment screws 43 from the base 30 and the surface 42 of the mounting arm 40. The mounting arm 40 is then rotated about its longitudinal axis 180° so that the inwardly-facing side 41 of the mounting arm 40 will face the archer's right side and be in contact with the seat 26. Once the mounting arm 40 has been repositioned, the bow alignment adjustment screws 43 are then reinserted into the base 30 and threaded into the threaded bow alignment adjustment screw holes 47 of the surface 42 of the mounting arm 40. The carriage 70 is then slidably remounted on the base 30 so that the sight pin 82 faces the right side of the archer.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. An adjustable archery bow sight for attachment to a bow, said sight comprising:
   (a) a base;
   (b) mounting means connected to the base to provide for attachment of the sight to the bow;
   (c) a carriage which is slidably mounted on the base for movement along an axis of travel;
   (d) a planar surface on one of said carriage and said base;
   (e) a drive roll which is mounted to the other of said base and said carriage for rotation about an axis of rotation, said drive roll having an outer circumferential surface which engages said planar surface, a first one of said circumferential surface and said planar surface being knurled and non-conformable and a second one of said circumferential surface and said planar surface being softer than said first surface and conformable in a complementary driving manner to said first surface so that rotation of said drive roll about said axis of rotation causes said carriage to slide relative to the base along said axis of travel;
   (f) rotating means for rotating said drive roll about said axis of rotation; and
   (g) a sight pin assembly which is mounted on the carriage.

2. The adjustable archery bow sight as recited in claim 1, wherein the surface that is conformable retains an imparted deformation.

3. The adjustable archery bow sight as recited in claim 1, wherein the drive roll is mounted to the base.

4. The adjustable archery bow sight as recited in claim 1, wherein said circumferential surface is knurled and non-conformable and said planar surface is softer than said circumferential surface.

5. The adjustable archery bow sight as recited in claim 4, wherein the drive roll is mounted to the base.

6. The adjustable archery bow sight as recited in claim 1, wherein the mounting means is comprised of a mounting arm affixed to the base, said mounting arm being adjustably attachable to the bow, and said mounting arm having a central longitudinal axis.

7. The adjustable archery bow sight as recited in claim 6, wherein the mounting arm is adjustably mounted on the base so that the central longitudinal axis of the mounting arm is transverse to said axis of travel.

8. The adjustable archery bow sight as recited in claim 1, wherein the sight pin assembly is adjustably mounted on the carriage to allow for movement parallel to said axis of travel.

9. The adjustable archery bow sight as recited in claim 1, wherein the rotating means is comprised of a shaft which rotatably supports said drive roll and a finger grip adjustment knob connected to said shaft.

10. The adjustable archery bow sight as recited in claim 1, wherein the surface that is conformable is formed of a plastic polymer.

11. The adjustable archery bow sight as recited in claim 10, wherein the plastic polymer is a crystalline thermoplastic polymer.

12. The adjustable archery bow sight as recited in claim 11, wherein the crystalline thermoplastic polymer is polyoxymethylene.

13. The adjustable archery bow sight as recited in claim 1, further comprising pressure applying means for forcing said first surface against said second surface.

14. The adjustable archery bow sight as recited in claim 13, wherein the rotating means is comprised of a shaft which rotatably supports said drive roll, and wherein said pressure applying means comprises pressure screw means which is mounted in said base and which operatively engages said shaft.

15. The adjustable archery bow sight as recited in claim 14, wherein said base has at least one threaded hole which extends from said shaft to the outside of said base and said pressure screw means comprises:
   (a) at least one plug which is freely slidable within said threaded hole and which abuts said shaft; and
   (b) at least one screw which is threaded into said threaded hole and which abuts said plug.

16. The adjustable archery bow sight as recited in claim 15, wherein the plug is formed of a material which is softer than the material of the shaft.

17. An adjustable archery sight pin assembly carrier for carrying a sight pin assembly and for attachment to a bow, said carrier comprising:
   (a) a base;
   (b) mounting means connected to the base to provide for attachment of the carrier to the bow;
   (c) a carriage which is slidably mounted on the base for movement along an axis of travel;
   (d) a planar surface on one of said carriage and said base;
   (e) a drive roll which is mounted to the other of said base and said carriage for rotation about an axis of rotation, said drive roll having an outer circumferential surface which engages said planar surface, a first one of said circumferential surface and said planar surface being knurled and non-conformable and a second one of said circumferential surface and said planar surface being softer than said first surface and conformable in a complementary driving manner to said first surface so that rotation of said drive roll about said axis of rotation causes said carriage to slide relative to the base along said axis of travel;

(f) rotating means for rotating said drive roll about said axis of rotation; and (g) means for mounting a sight pin assembly to the carriage.

18. The adjustable archery sight pin assembly carrier as recited in claim 17, wherein said means for mounting a sight pin assembly to the carriage provides for adjustable attachment of the sight pin assembly to the carriage to allow for movement parallel to said axis of travel.

* * * * *